US007117694B2

(12) United States Patent
Braun et al.

(10) Patent No.: US 7,117,694 B2
(45) Date of Patent: Oct. 10, 2006

(54) SYSTEM COMPONENT HAVING A BRAKING SPRING

(75) Inventors: Jochen Braun, Nusplingen (DE); Uwe Hennig, Burladingen (DE)

(73) Assignee: Groz-Beckert AG, Albstadt (DE)

( * ) Notice: Subject to any disclaimer, the term of this patent is extended or adjusted under 35 U.S.C. 154(b) by 0 days.

(21) Appl. No.: 11/108,847

(22) Filed: Apr. 19, 2005

(65) Prior Publication Data

US 2005/0235700 A1 Oct. 27, 2005

(30) Foreign Application Priority Data

Apr. 21, 2004 (EP) ..... 04009397

(51) Int. Cl.
*D04B 35/04* (2006.01)

(52) U.S. Cl. ..... 66/123

(58) Field of Classification Search ..... 66/116, 66/119–124

See application file for complete search history.

(56) References Cited

U.S. PATENT DOCUMENTS

| | | | | |
|---|---|---|---|---|
| 1,178,682 | A * | 4/1916 | Scott | 66/124 |
| 2,004,617 | A * | 6/1935 | Roy | 66/124 |
| 2,024,911 | A * | 12/1935 | Crawford | 66/124 |
| 2,592,787 | A * | 4/1952 | Blickle | 66/124 |
| 3,712,082 | A * | 1/1973 | Kohorn | 66/19 |
| 4,068,500 | A * | 1/1978 | Kohorn | 66/123 |
| 4,089,192 | A * | 5/1978 | Kohorn | 66/123 |
| 5,097,683 | A | 3/1992 | Schüler et al. | |
| 6,848,279 | B1 | 2/2005 | Fehrenbacher | |

FOREIGN PATENT DOCUMENTS

| | | |
|---|---|---|
| DE | 2 043 566 | 4/1971 |
| DE | 2 315 836 | 3/1974 |
| DE | 33 36 212 C1 | 1/1985 |
| DE | 39 21 506 C1 | 8/1990 |
| EP | 1 298 238 A1 | 4/2003 |

* cited by examiner

*Primary Examiner*—Danny Worrell
(74) *Attorney, Agent, or Firm*—Norman N. Kunitz; Fitch, Even, Tabin & Flannery

(57) ABSTRACT

A knitting tool (1) is provided with a braking spring (15) formed on the knitting tool as a one-piece member thereof. The braking spring has a thickness (W) which is less than that of the knitting tool (1), whereby the braking spring (15) may yield to a great extent and has a soft spring characteristic. Such a result may be achieved even with short spring lengths, whereby dimensional deviations of the spring have only a slight effect on the spring force. The structure is only slightly prone to soiling. The knitting tool may be manufactured in a simple manner.

24 Claims, 4 Drawing Sheets

SYSTEM COMPONENT HAVING A BRAKING SPRING

CROSS REFERENCE TO RELATED APPLICATION

This application claims the priority of European Patent Application No. 04 009 397.3, filed on Apr. 21, 2004, the subject matter of which, in its entirety, is incorporated herein by reference.

FIELD OF THE INVENTION

The invention relates to a system component forming part of a knitting system of a loop-forming machine. Such a component may be, for example, a machine knitting needle, a selecting component, a sinker or the like.

BACKGROUND OF THE INVENTION

System components of knitting machines are, as a rule, longitudinally slidably guided in grooves, such as needle grooves of a needle cylinder or similar slot-like guides. The longitudinal motion of the system component is generated by a suitable drive, such as a cam which moves relatively to a projection (termed as a butt) of the system component. The butt extends into a corresponding groove which has a shape corresponding to the driven motion of the system component. Between the cam and the butt a relatively large, position-dependent clearance is present. As a rule, measures are taken for braking the system component to avoid uncontrolled motions thereof despite the presence of the clearance.

As disclosed in German Patent No. 33 36 212, it is known to provide a stamped-out knitting tool with a slight lateral bend. For supporting such a bend, the knitting tool is, along its entire height, provided with a depression which may be filled with a dampening material. By virtue of the bend the knitting tool resiliently engages the flanks of the guide groove. The generated friction brakes the axial motions.

The recess constitutes a weakened location. Further, a bending of the entire knitting tool may result in a faulty positioning of the latter.

Further, German Patent No. 39 21 506 C1 shows knitting tools for loop-forming machines, where the knitting tools are provided with a lateral offset which may be utilized to position very narrow knitting tools in relatively wide guide grooves. The intermediate spaces, however, are prone to soiling.

It is therefore an object of the invention to provide a simple, reliable knitting tool which is provided with a braking device.

SUMMARY OF THE INVENTION

This object is achieved with a system component as defined in claim 1:

This object is achieved with the system component according to the invention includes a shank having flanks which are essentially parallel to one another. In at least one of the flanks a recess is formed, in the region of which a spring or resilient tongue is arranged which forms a one-piece, i.e., integrated, part of the shank. In this manner the spring tongue has a thickness which is less than the thickness of the shank. The spring tongue is held in a simple manner captive on the system component. Manufacturing is simple and reliable. By virtue of the tongue thickness which is reduced relative to the thickness of the system component proper, the tongue, even if it has only a short length, may be flexible to a high degree. In particular, flat spring characteristics may be achieved. In this manner a good tolerance equalization may be provided also as far as the width of the guide groove is concerned in which the system component is positioned. As compared to free-standing spring tongues, whose thickness corresponds to the shank thickness, flatter spring characteristics may be obtained.

The flanks of the system component are preferably planar surfaces which, if required, may lie face-to-face against the flanks of a guide groove.

The thickness of the spring tongue is preferably significantly less than the thickness of the system component defined by the distance between its flanks. For this purpose it is sufficient to provide the recess solely at one side of the system component. It is, however, also feasible to form recesses on both sides or flanks of the system component, in which case the recesses together bound a thin wall portion serving to form the spring tongue. The spring tongue is set free by the provision of a U-shaped cut. The width of such a cut is preferably greater than the thickness of the tongue; this has manufacturing advantages and provides for a satisfactory free motion of the tongue.

The spring tongue may be bent into or away from the recess. In either case the tongue may be tapered toward its end both in its thickness and in its height for improving its flexibility and to avoid the concentration of its bending movement solely in the region of its root. A tapering of the tongue thickness may be obtained by providing the recess with an increasing depth toward the spring tip.

The recess preferably has a closed edge which means that the recess is surrounded on all sides by an otherwise planar flank portion. Thus, the recess is inaccessible particularly from the upper side of the needle, so that it has little tendency, if any, to gather soil or undergo wear. If required, the edge may be interrupted toward the needle back; in that region a tendency to accumulate dirt is less.

Further details of advantageous embodiments of the invention may be found in the drawing, the specification or the claims. In the drawing, which show embodiments of the invention,

DETAILED DESCRIPTION OF THE INVENTION

Figure 1:
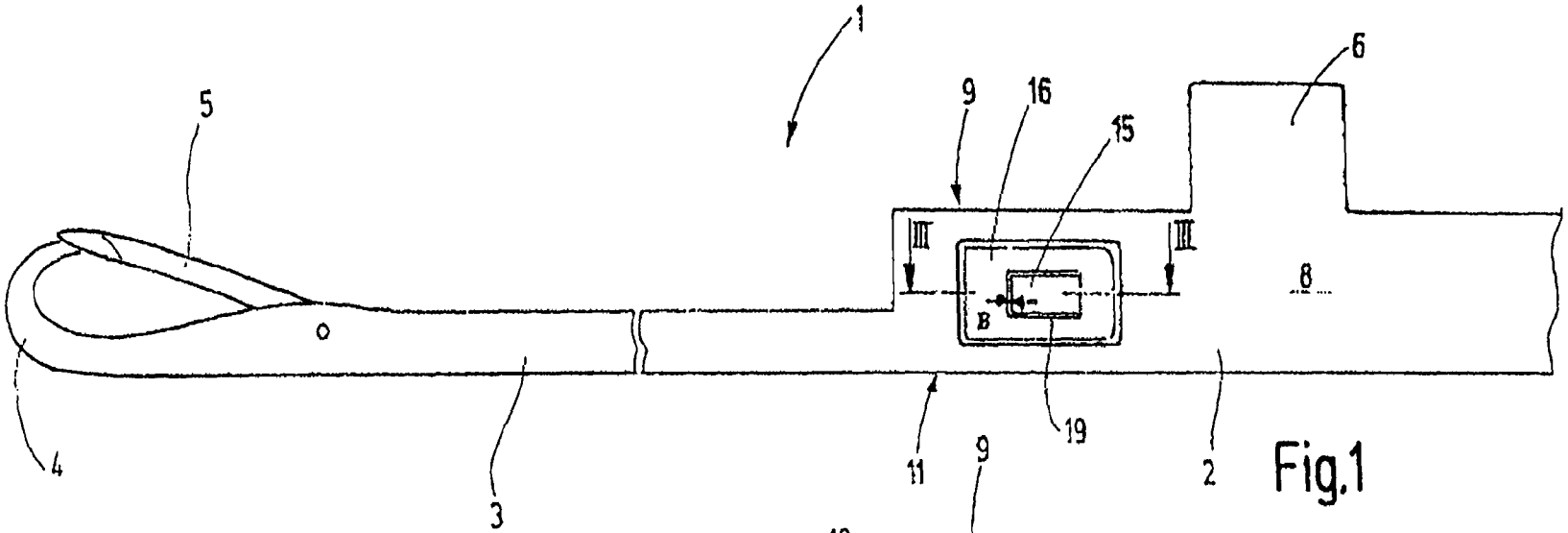
FIG. 1 is a schematic side elevational view of a system component constituted by a knitting needle having a braking spring formed thereon as a one-piece part.
Figure 2:
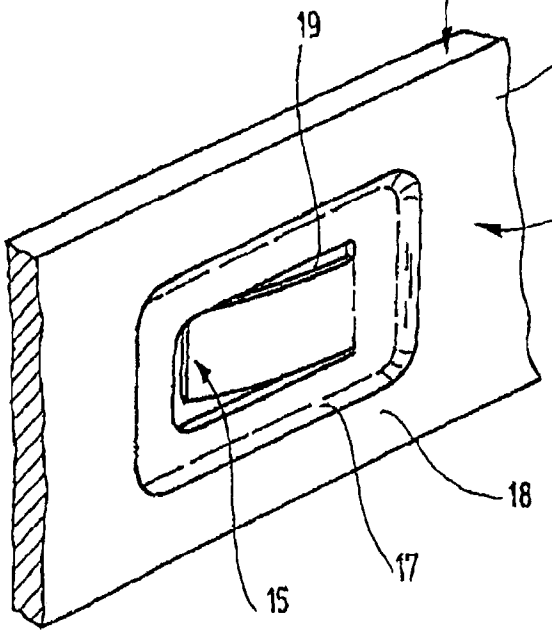
FIG. 2 is a fragmentary perspective view, on a different scale, of the knitting needle as shown in FIG. 1.

FIG. 1 shows a knitting needle 1 belonging to a knitting system and constituting a component thereof. The knitting needle 1 has a shank 2 which at one end changes into a shank region 3 of lesser height. At its end the shank region 3 carries a hook 4. If required, a pivotally supported latch 5 may be associated with the hook 4. At least one butt 6, cooperating with a drive, such as a cam, is formed on the shank 2. The shank 2 is a flat part having a rectangular cross section.

Figure 3:
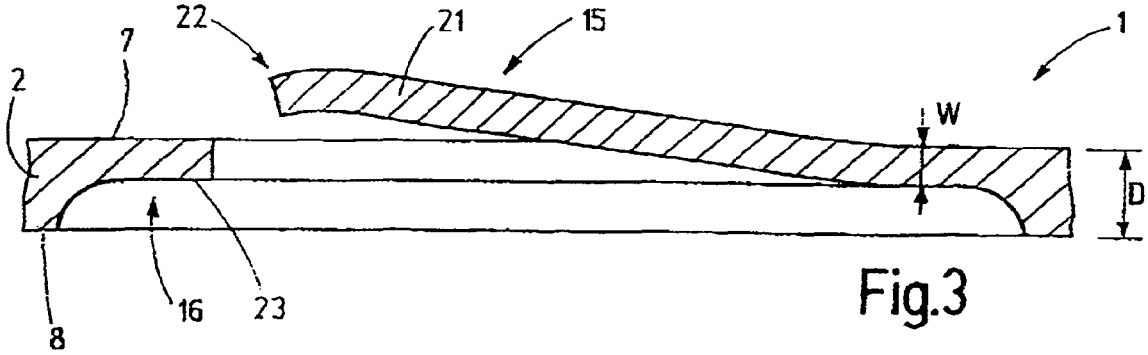
FIG. 3 is a sectional view of the knitting needle of FIGS. 1 and 2, taken along line III—III.

As illustrated in FIG. 3, the shank 2 has two, preferably planar flanks 7, 8 which, as shown in FIG. 1, extend from the upper needle side 9 to the needle back 11.

Figure 8:
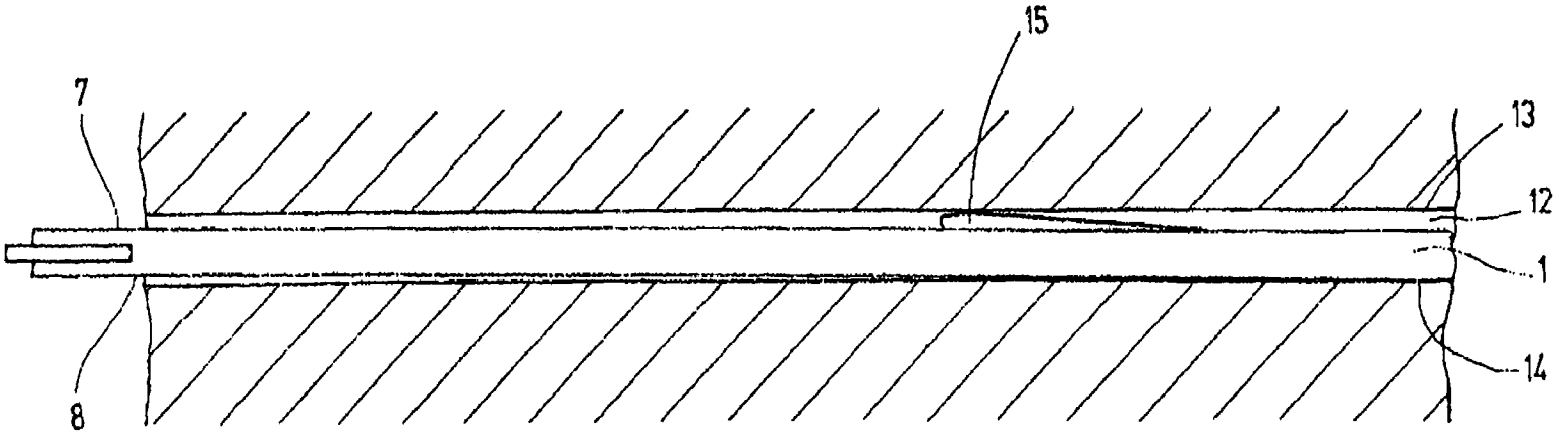
FIG. 8 is a fragmentary top plan view of the knitting needle situated in a needle groove.

A braking spring 15 is formed on the shank 2 for supporting the knitting needle 1 in a needle groove 12, as shown, for example, in FIG. 8, in such a manner on the side surfaces 13, 14 that the knitting needle 1 can be moved in the axial direction with a certain hindrance. For this purpose, at a suitable location of the shank 2, for example, in the shank region 3 or at another location in the vicinity of the butt 6, or even directly below the butt 6, at least one recess 16 is formed which presents a flat depression having an arcuate or a preferably planar bottom. The recess 16 is surrounded by a closed edge 17, whereby the recess 16 is of closed configuration axially forward, rearward as well as toward the upper needle side 9 and the needle back 11. The edge 17 is bounded all around by a surface region 18 of the flank 8, whereby the surface region 18 forms a closed ring about the edge 17.

The recess 16 forms a depression in the flank 8, as particularly well shown in FIG. 3. The wall thickness W remaining in the region of the depression is significantly less than the thickness D of the shank 2 measured between the flanks 7, 8. A U-shaped cut 19, as seen, for example, in FIG. 1, sets the braking spring 15 free to constitute a resilient tongue 21, whose thickness corresponds to the wall thickness W. The tongue 21 is slightly bent out of the plane of the flank 7, and its free end 22 may be outwardly bulging or rounded.

As shown, the cut 19 may be generally rectangular; its width B is preferably greater than the wall thickness W, so that the tongue 21 is set free by a distance from the surrounding material of the bottom of the depression 16. In this manner an interference with the motion of the tongue 21 by friction, dirt or the like may be avoided.

The knitting needle 1 described above may be inserted into the needle groove 12 as shown in FIG. 8. The groove 12 is narrow to such an extent that the tongue 21, that is, the braking spring 15, is resiliently supported on the side surface 13, whereby the knitting needle 1 is pressed against the facing side surface 14. A friction is generated which slightly hinders the longitudinal motion of the knitting needle 1. The tongue 21, because of its small thickness, may flex to a relatively large extent, and has a large springing amplitude. The surface required for forming the recess 16 and the tongue 21 is relatively small, and there is no substantial weakening of the shank 2 as concerns to its stability. If required, several such recesses 16 and tongues 21 may be provided.

Figure 4:
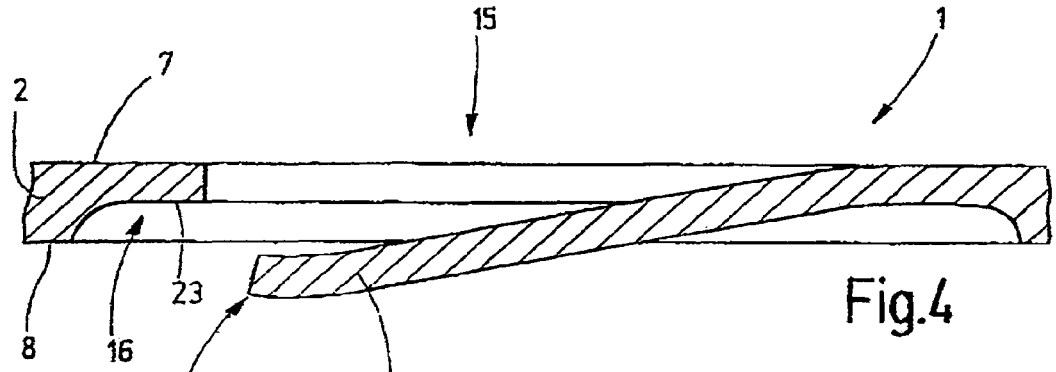
FIG. 4 is a sectional view of a modified embodiment of the knitting needle of FIG. 1, taken along line III—III.

FIG. 4 illustrates a modified embodiment of the knitting needle 1. While reference is made in its entirety to the preceding description, the difference resides in that the tongue 21 is bent in the direction of the flank 8 through the recess 16, rather than away therefrom. In this embodiment too, the end 22 is rounded.

Figure 5:
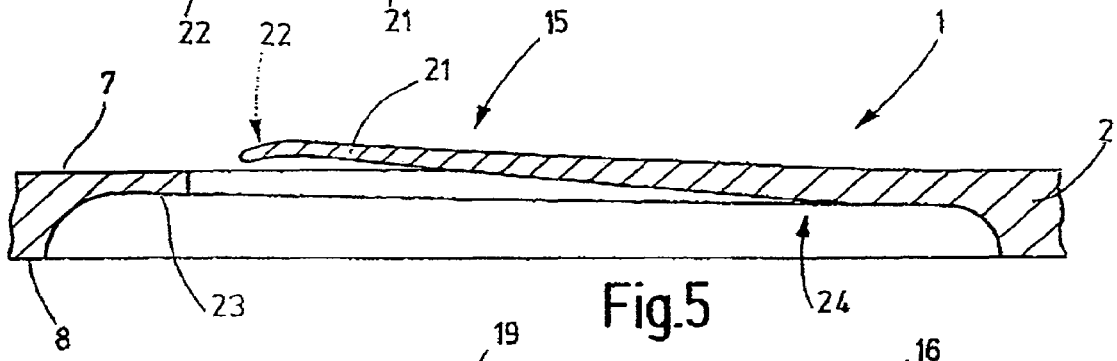
FIG. 5 is a sectional view of a further modified embodiment of the knitting needle of FIG. 1, taken along line III—III.

While in both precedingly described embodiments the recess 16 has a bottom 23 which is planar and extends essentially parallel to the flank 8, FIG. 5 shows an embodiment of the knitting needle 1 where the bottom 23 is oriented at an acute angle to the longitudinal direction of the knitting needle 1 and is thus oriented at an acute angle to the flanks 7, 8. By virtue of this arrangement, the wall thickness W of the tongue 21 tapers from its beginning, that is, from its root 24, to its end 22. This feature provides for a particularly flexible braking spring 15 which, in addition, may have particularly small dimensions. The outline of the tongue 21 may be rectangular, similarly to the precedingly described embodiments.

Figure 6:
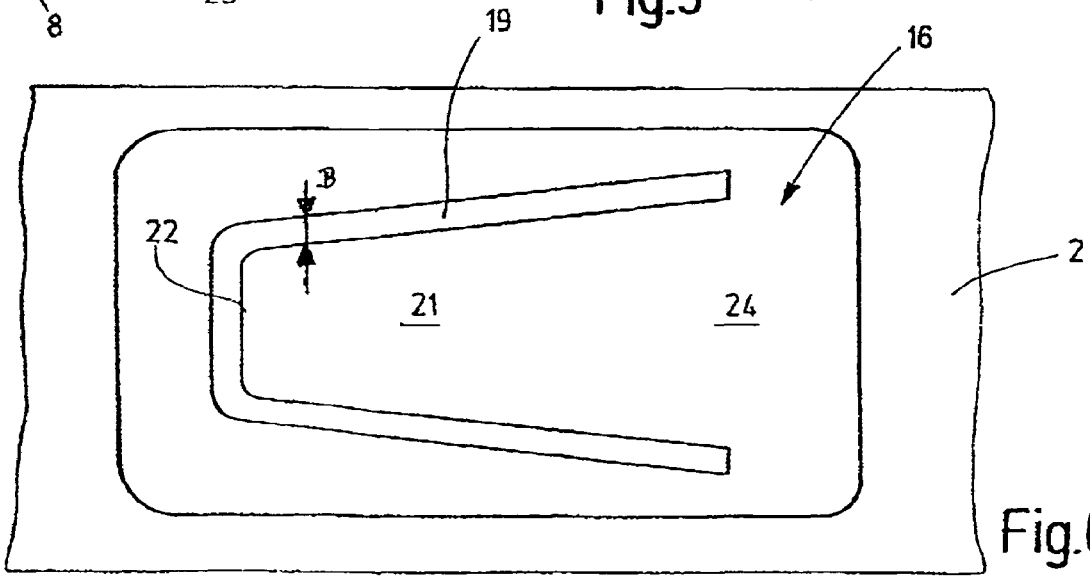
FIG. 6 is a fragmentary side elevational view of a knitting needle corresponding to the knitting needle of FIG. 1 and having a modified tongue.

In all the precedingly described embodiments it is feasible to deviate from a rectangular tongue outline. FIG. 6 illustrates an embodiment where the thickness of the tongue 21 may be constant as in FIG. 3 or 4, or may taper as in FIG. 5. The tongue 21 may have, for example, a trapezoidal outline. Accordingly, the cut 19 is approximately V shaped. The tongue 21 may terminate at its end 22 in an edge, a rounding or a point. By virtue of a simple or dual tapering of the tongue 21 toward its end 22 a particularly good yielding property for the tongue 21 may be achieved.

Figure 7:
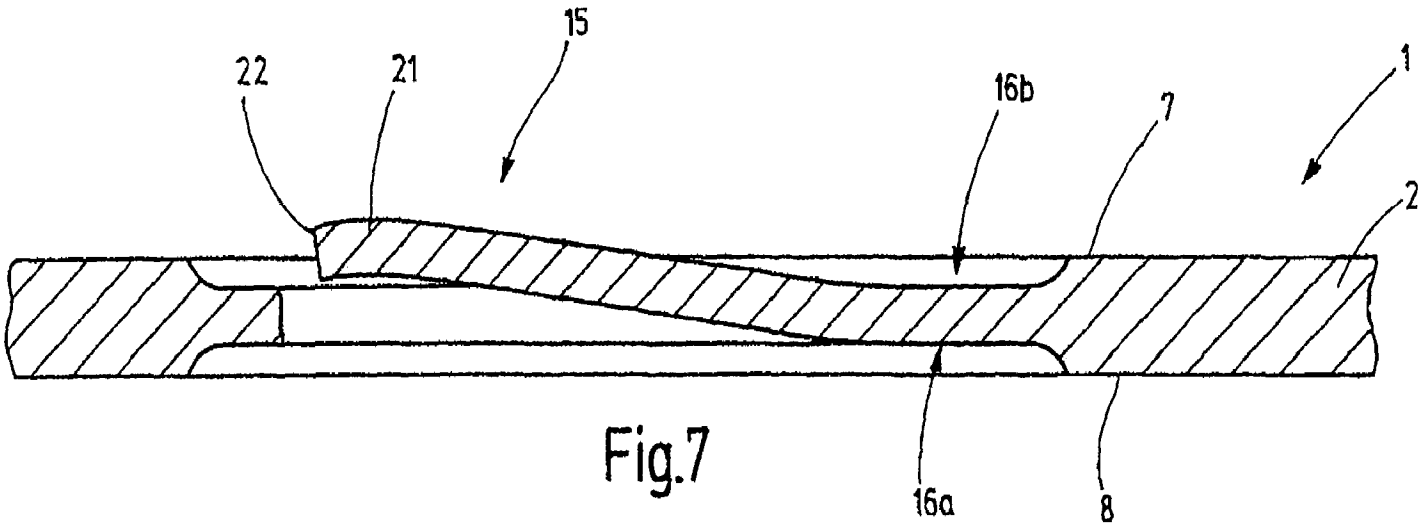
FIG. 7 is a sectional view of a modified embodiment of the knitting needle of FIG. 3.

FIG. 7 shows a modified embodiment of the knitting needle 1 in which in both flanks 7, 8 recesses 16*a*, 16*b* are provided. The recesses 16*a*, 16*b* may be of identical size and depth and may have a constant depth as in the embodiments illustrated in FIGS. 3 and 4. Either recess 16*a* or 16*b*, however, may have a size or shape that is different from the respective other recess. In particular, one or both recesses 16*a*, 16*b* may be wedge shaped, similarly to FIG. 5. Thus, the tongue 21 has either a constant thickness as shown, or is wedge-shaped, tapering toward its end 22. Further, on the shank 2 several tongues 21 may be provided which are bent either toward the same flank 7 or 8, or are bent toward different flanks. The plurality of tongues may be arranged in a single, common recess or in separate recesses and may be rectangular, trapezoidal or triangular.

Figure 9:
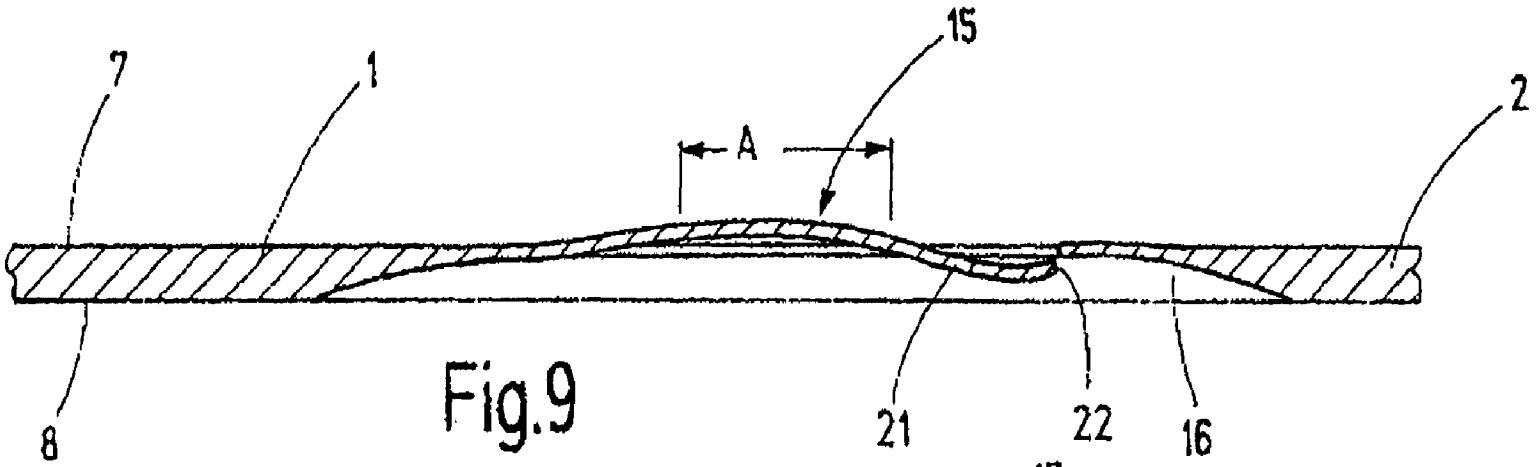
FIG. 9 is a fragmentary sectional top plan view of a modified embodiment of the knitting needle, illustrated in a relaxed state.

FIG. 9 shows a further modified embodiment of the knitting needle 1. While reference is made in its entirety to the preceding description using the same reference numerals, the difference resides in that the tongue 21 is first bent away from the recess 16 beyond the flank 7 and, after reaching the highest point of the bend, it is bent into the recess 16, so that its rounded end 22 lies in the region of the recess 16.

Figure 10:
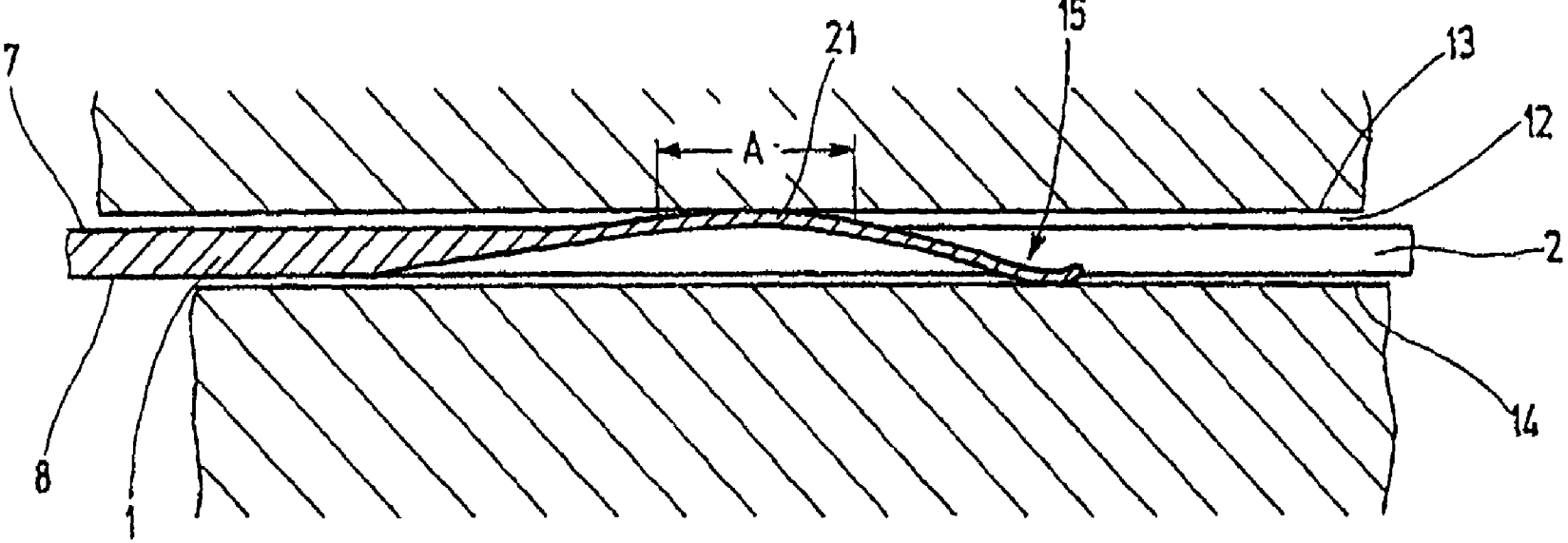
FIG. 10 is a fragmentary sectional top plan view of the knitting needle according to FIG. 9, illustrated in an installed state.

In the installed state (FIG. 10) the braking spring 15 contacts with its end 22 the side surface 14 and with its mid portion A the side surface 13 of the needle groove 12. In this manner the knitting needle 1 is guided approximately centrally in the needle groove 12 in the region of the braking spring and is bilaterally supported by means of the braking spring 15 by the side surfaces 13, 14 of the needle groove 12. The end 22 of the tongue 21 of the knitting needle 1 is supported by the side surface 14 of the needle groove 12. The side surface 14 is remote from the flank 7, to which the braking spring is connected.

A knitting tool 1 is provided with a braking spring 15 formed on the knitting tool as a one-piece member thereof. The braking spring 15 has a thickness W which is less than that of the knitting tool 1, whereby the braking spring 15 can yield to a great extent and has a soft spring characteristic. Such a result may be achieved even with short spring lengths, whereby dimensional deviations of the spring have only a slight effect on the spring force. The structure is only slightly prone to soiling. The knitting tool may be manufactured in a simple manner.

It will be appreciated that the above description of the present invention is susceptible to various modifications, changes and adaptations, and the same are intended to be comprehended within the meaning and range of equivalents of the appended claims.

LIST OF REFERENCE CHARACTERS

1 knitting needle
2 shank
3 shank region
4 hook
5 latch
6 butt
7, 8 flanks
9 upper needle side
11 needle back
12 needle groove
13, 14 side surfaces
16, 16*a*, 16*b* recesses
17 edge
18 surface region
19 cut
21 tongue
22 end
23 bottom
24 root
A region
B width
D thickness
W wall thickness

What is claimed is:

1. A system component of a knitting system of a stitch-forming machine, comprising a shank having two flanks that are substantially parallel to one another and have a distance from one another that defines the thickness (D) of the system component, a recess formed in at least one of the flanks, and a resilient tongue formed on the shank in the region of the recess, with the tongue being a one-piece part of the shank, having a thickness that is less than the thickness (D) of the system component, and projecting beyond one of the flanks.

2. The system component as defined in claim 1, wherein the flanks are planar surfaces.

3. The system component as defined in claim 1, wherein the resilient tongue is set free from the shank by a U-shaped cut.

4. The system component as defined in claim 3, wherein the cut has a width (B) which is at least as large as the thickness (W) of the tongue.

5. The system component as defined in claim 1, wherein the tongue is bent away from the recess.

6. The system component as defined in claim 1, wherein the tongue is bent into the recess.

7. The system component as defined in claim 1, wherein the tongue has a constant thickness (W).

8. The system component as defined in claim 1, wherein the tongue tapers in its thickness (W) toward its free end.

9. The system component as defined in claim 1, wherein the tongue tapers in its height toward its free end.

10. The system component as defined in claim 1, wherein the tongue has a rounded end.

11. The system component as defined in claim 1, wherein the recess has a constant depth.

12. The system component as defined in claim 1, wherein the recess has a depth which increases toward the free end of the tongue.

13. The system component as defined in claim 1, wherein the recess has a closed edge.

14. The system component as defined in claim 1, wherein the system component is a machine knitting needle.

15. The system component as defined in claim 1, wherein the tongue extends in the longitudinal direction of the shank.

16. The system component as defined in claim 2 wherein the resilient tongue is formed by a cut that extends through the shank in the bottom of the recess and wherein the difference between the thickness (D) of the system component, and the thickness of the resilient tongue corresponds to the depth of the recess.

17. A system component of a knitting system of a stitch-forming machine, comprising:

a shank having two flanks extending substantially parallel to one another and having a distance from one another that defines the thickness (D) of the system component;

a recess formed within at least one of the flanks, with the recess extending only partly through the shank and having a closed edge, so that the recess is bounded all around by a surface region of the flank; and, a resilient tongue formed from the shank within the region of the recess as a one-piece part of the shank, with the resilient tongue projecting beyond one of the flanks and having a thickness that is less than the thickness (D) of the system component.

18. The system component as defined in claim 17, wherein the resilient tongue is formed by a cut that extends through the shank in the bottom of the recess.

19. The system component as defined in claim 18 wherein the resilient tongue is set free from the shank by a U-shaped cut.

20. The system component as defined in claim 18, wherein the cut has a width (B) which is at least as large as the thickness (W) of the tongue.

21. The system component as defined in claim 17, wherein the recess has a constant depth, and the tongue has a constant thickness (W).

22. The system component as defined in claim 17, wherein the recess has a depth which increases toward the free end of the tongue, and the tongue tapers in its thickness (W) toward its free end.

23. The system component as defined in claim 17, wherein the tongue extends in the longitudinal direction of the shank.

24. The system component as defined in claim 17, wherein the two flanks are planar surfaces.

* * * * *